US010570565B2

(12) United States Patent
Männer et al.

(10) Patent No.: US 10,570,565 B2
(45) Date of Patent: Feb. 25, 2020

(54) FAST-FIBRILLATING LYOCELL FIBERS, AND USE THEREOF

(71) Applicant: LENZING AG, Lenzing (AT)

(72) Inventors: Johann Männer, Weyregg (AT); Rudolf Aigner, Lenzing (AT); Jim Gannon, North East Lincolnshire (GB); Matt Riley, North East Lincolnshire (GB)

(73) Assignee: Lenzing Aktiengesellschaft, Lenzing (AU)

( * ) Notice: Subject to any disclaimer, the term of this patent is extended or adjusted under 35 U.S.C. 154(b) by 0 days.

(21) Appl. No.: 15/518,919

(22) PCT Filed: May 29, 2015

(86) PCT No.: PCT/AT2015/000082

§ 371 (c)(1),
(2) Date: Apr. 13, 2017

(87) PCT Pub. No.: WO2016/065377

PCT Pub. Date: May 6, 2016

(65) Prior Publication Data

US 2017/0241079 A1 Aug. 24, 2017

(30) Foreign Application Priority Data

Oct. 29, 2014 (AT) ..... 793-2014

(51) Int. Cl.
*D21H 13/08* (2006.01)
*D01D 5/42* (2006.01)
(Continued)

(52) U.S. Cl.
CPC ..... *D21H 13/08* (2013.01); *D01D 5/423* (2013.01); *D01F 2/00* (2013.01); *D04H 1/4258* (2013.01); *D04H 1/4382* (2013.01); *D21H 11/00* (2013.01)

(58) Field of Classification Search
CPC ..... D21H 13/08; D21H 11/00; D21H 27/002; D01F 2/00; D01F 2/24; D01F 2/30;
(Continued)

(56) References Cited

U.S. PATENT DOCUMENTS 5,725,821 A 3/1998 Gannon et al.
6,042,769 A * 3/2000 Gannon ..... D01F 2/00 264/203
(Continued)

FOREIGN PATENT DOCUMENTS

AT 515693 A4 * 11/2015 ..... D21H 13/08
DE 69513978 T2 5/2000
(Continued)

OTHER PUBLICATIONS

International Preliminary Report on Patentability and Written Opinion issued in International Application PCT/AT2015/000082 (12 pages).
(Continued)

*Primary Examiner* — Jose A Fortuna
(74) *Attorney, Agent, or Firm* — Venable LLP

(57) ABSTRACT

The present invention relates to fibrillated lyocell fibers which have a fibrillation quotient Q of 20 or more and whose content of microfibers with a fineness of less than 14 mesh and a diameter of less than 2 μm is at least 50%, as well as the use thereof for producing a wipe, which contains pulp and 5 to 20 wt. % of fibrillated lyocell fibers.

7 Claims, 1 Drawing Sheet

(51) Int. Cl.

| | |
|---|---|
| ***D01F 2/00*** | (2006.01) |
| ***D04H 1/4258*** | (2012.01) |
| ***D04H 1/4382*** | (2012.01) |
| ***D21H 11/00*** | (2006.01) |

(58) Field of Classification Search
CPC .... D01D 5/423; D04H 1/4258; D04H 1/4382; D04H 1/42; D06M 2200/35; Y10T 428/249965; Y10T 442/60; B08B 1/00
See application file for complete search history.

(56) References Cited

U.S. PATENT DOCUMENTS

| | | | | |
|---|---|---|---|---|
| 6,235,392 | B1 * | 5/2001 | Luo | D01D 5/098 264/177.11 |
| 6,602,994 | B1 | 8/2003 | Cash et al. | |
| 8,187,422 | B2 | 5/2012 | Sumnicht et al. | |
| 9,222,222 | B2 | 12/2015 | Dodd | |
| 10,030,323 | B2 * | 7/2018 | Durnberger | D04H 1/28 |
| 2007/0224419 | A1 * | 9/2007 | Sumnicht | D21C 9/005 428/364 |
| 2009/0020139 | A1 | 1/2009 | Sumnicht et al. | |
| 2010/0288456 | A1 * | 11/2010 | Westland | D21H 17/25 162/57 |
| 2012/0043038 | A1 * | 2/2012 | Dodd | D21H 11/18 162/141 |
| 2012/0180815 | A1 | 7/2012 | Sumnicht et al. | |
| 2013/0029106 | A1 | 1/2013 | Lee et al. | |
| 2014/0004326 | A1 | 1/2014 | Petersen et al. | |
| 2014/0144466 | A1 | 5/2014 | Sumnicht et al. | |
| 2014/0144598 | A1 | 5/2014 | Sumnicht et al. | |
| 2015/0114581 | A1 | 4/2015 | Kinnunen et al. | |
| 2015/0122432 | A1 | 5/2015 | Sumnicht et al. | |
| 2015/0122434 | A1 | 5/2015 | Sumnicht et al. | |
| 2015/0122435 | A1 | 5/2015 | Sumnicht et al. | |
| 2015/0122436 | A1 | 5/2015 | Sumnicht et al. | |
| 2015/0122437 | A1 | 5/2015 | Sumnicht et al. | |
| 2015/0122438 | A1 | 5/2015 | Sumnicht et al. | |
| 2015/0122439 | A1 | 5/2015 | Sumnicht et al. | |
| 2015/0129147 | A1 | 5/2015 | Sumnicht et al. | |
| 2015/0144157 | A1 | 5/2015 | Sumnicht et al. | |
| 2015/0144158 | A1 | 5/2015 | Sumnicht et al. | |
| 2015/0144281 | A1 | 5/2015 | Sumnicht et al. | |
| 2015/0164295 | A1 | 6/2015 | Sumnicht et al. | |
| 2015/0173581 | A1 | 6/2015 | Sumnicht et al. | |
| 2015/0173582 | A1 | 6/2015 | Sumnicht et al. | |
| 2015/0173583 | A1 | 6/2015 | Sumnicht et al. | |
| 2015/0176215 | A1 | 6/2015 | Sumnicht et al. | |
| 2015/0182092 | A1 | 7/2015 | Sumnicht et al. | |
| 2016/0060792 | A1 * | 3/2016 | Durnberger | D04H 1/28 162/157.7 |
| 2017/0241079 | A1 * | 8/2017 | Manner | D21H 13/08 |
| 2017/0328012 | A1 * | 11/2017 | Lee | D21H 27/005 |
| 2018/0163345 | A1 * | 6/2018 | Goldhalm | D21H 13/08 |

FOREIGN PATENT DOCUMENTS

| | | | | |
|---|---|---|---|---|
| GB | 1395757 | | 5/1975 | |
| JP | 2003/278091 | A | 10/2003 | |
| WO | 95/35399 | A1 | 12/1995 | |
| WO | 2013/160553 | A1 | 10/2013 | |
| WO | WO-2016065377 | A1 * | 5/2016 | D21H 13/08 |

OTHER PUBLICATIONS

International Search Report issued in International Application PCT/AT2015/000082 (5 pages).

B. Radvan and A.P.J. Gatward, "The Formation of Wet-Laid Webs by a Foaming Process," Tappi, 55(5), pp. 748-751 (1972).

"New Process Uses Foam in Papermaking Instead of Avoiding It," Paper Trade Journal (1971).

M.K. Smith, et al., "The structure and properties of paper formed by a foaming process," Tappi, 57(1), pp. 107-111 (1974).

* cited by examiner

FAST-FIBRILLATING LYOCELL FIBERS, AND USE THEREOF

The present application is a national-stage entry under 35 U.S.C. § 371 of International Patent Application No. PCT/AT2015/000082, filed May 29, 2015, which claims priority to Austrian Patent Application No. A 793-2014 filed Oct. 29, 2014, the entire disclosure of each of which is incorporated by reference herein.

The present invention relates to fibrillated lyocell fibers which have a fibrillation quotient Q of 20 or more and whose content of microfibers with a fineness of less than 14 mesh and a diameter of less than 2 μm is at least 50%, as well as the use thereof for producing a wipe, which contains pulp and 5 to 20 wt. % of fibrillated lyocell fibers.

PRIOR ART

U.S. Pat. No. 6,042,769 discloses a process by which the fibrillation tendency of lyocell fibers is increased by a treatment which reduces the degree of polymerization of the cellulose by at least 200 units. The resulting fiber is intended mainly for use in nonwovens and paper. Preferably, the treatment is performed with a bleaching agent, in particular with sodium hypochlorite. Alternatively, treatment with an acid, preferably a mineral acid such as hydrochloric acid, sulfuric acid or nitric acid is also possible. However, this process has not yet been implemented commercially.

The use of regenerated cellulose fibers such as viscose and lyocell in nonwovens is well known. In particular, lyocell fibers are fibrillated by milling or also in so-called refiners, which are known from paper manufacture, and are used as cellulose microfibers mixed with paper pulp in so-called wet-laid processes (also referred to as "wet-laid" processes among experts). Various products such as, e.g., wiping or cleaning cloths, so-called wipes, and paper structures for e.g. tissues are produced. By way of example, U.S. Pat. No. 8,187,422 describes that the properties of disposable cellulosic wipes can be correspondingly optimized by the addition of fibrillated lyocell microfibers to paper pulp. In contrast to pure pulp wipes, the cleaning behavior is to be correspondingly improved by this admixture. Here, the optimized property profile is characterized by an increased opacity (light scattering) and porosity, while improving the soft grip. The higher porosity is intended to cause a higher absorption capacity for water and oil, which leads to an improved cleaning performance.

U.S. Pat. No. 8,187,422 does not describe exactly how the lyocell microfibers used are produced. It merely indicates that conventional lyocell staple fibers, such as, e.g. also used for the production of textiles, can be fibrillated in a disk refiner or similar unit in an aqueous medium at low solids content. The lyocell microfibers used according to U.S. Pat. No. 8,187,422 were purchased from a supplier in a fibrillated state. They have a degree of fibrillation of CSF<175 ml and a diameter of <2 μm. 40% of the fibers should have a fineness of finer than 14 mesh. The disposable wipes disclosed in U.S. Pat. No. 8,187,422 contain between 25 and 75% of the lyocell microfibers produced in this way.

The lyocell fibers employed according to U.S. Pat. No. 8,187,422 fibrillate in an aqueous medium under mechanical grinding stress. However, the effort to reach a certain degree of fibrillation according to U.S. Pat. No. 8,187,422 is significantly greater with respect to time and energy use with the present refiner technologies than for, for example, pulp.

Objective

In light of this prior art, the object was to provide fibers for use in wipes, which, on the one hand, can be fibrillated at lower cost, and, on the other hand, at a lower mass fraction in wipes allow the same mechanical properties of the wipes, such as, for example, high strength.

DESCRIPTION OF THE INVENTION

Figure 1:
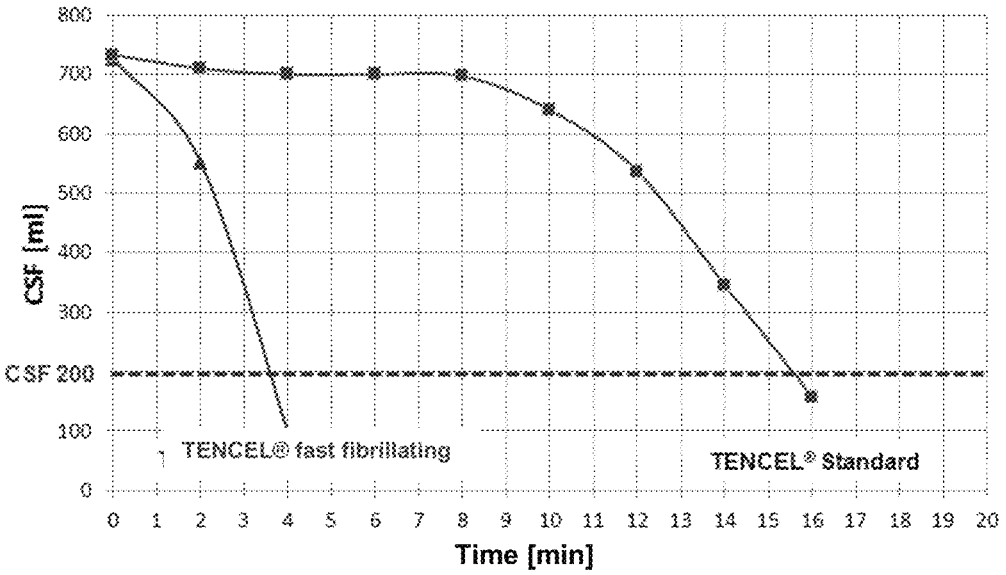
FIG. 1 is a graph depicting the CSF values for exemplary fibers in accordance with the present invention with increasing comminution time.

The above-described object has been achieved by fibrillated lyocell fibers which are characterized in that they have a fibrillation quotient Q of 20 or more and whose content of microfibers with a fineness of less than 14 mesh and a diameter of less than 2 μm is at least 50%. In order to avoid misunderstandings, it is understood that the term "fibrillated lyocell fibers" in the context of the present invention does not mean a total quantity of completely identical fibers, but a mixture of fibers of basically the same nature, in the mixture fibers of different fineness (measured in mesh) and different diameter.

The fibrillation quotient Q is defined as $$Q=200/t_{CSF200}$$

In this case, $t_{CSF200}$ is the time (in min) required in CSF testing to reach a CSF value of 200. The larger Q is, the less time is required at constant fibrillation conditions to reach the same degree of fibrillation. Depending on the type of the starting fibers and the acid treatment according to the invention, a Q value of up to 400 can be achieved.

Another subject of the present invention is a wipe that contains pulp and 5 to 20 wt. % of fibrillated lyocell fibers and wherein the fibrillated lyocell fibers have a fibrillation quotient Q of 20 or more. In a preferred embodiment, the pulp is paper pulp.

The fast fibrillating lyocell fibers could surprisingly be produced by an acid treatment of conventional lyocell fibers. According to the invention this acid treatment can be carried out by impregnating a fiber tow extruded from spinnerets in a known manner according to the lyocell process and having an individual fiber titer of, for example, between 1.0 and 6.0 dtex with dilute mineral acid, for example hydrochloric, sulfuric or nitric acid, with a concentration of for example between 0.5 and 5% at room temperature in a container at a liquor ratio of, for example, 1:10, and then pressed to a certain residual moisture content of, for example, 200%. The impregnated fiber tow is then subjected to water vapor at an overpressure in a suitable device, then washed until free of acid and dried.

To determine the fibrillation tendency, the fiber tow is cut to a staple length of 5 mm and subjected to CSF testing (Canadian Standard Freeness according to TAPPI standard T227 om-94).

The fiber tow is cut into staple fibers of suitable cutting length, for example 4 to 6 mm, for the manufacture of the wipes according to the invention. The fibrillation can then take place in a comminuting unit commonly used in the paper industry, for example, a milling unit, a refiner, a disintegrator or a hydrapulping unit. It is carried out there until the desired degree of fibrillation is reached.

The effect of the acid treatment and the resulting reduction in CSF can be influenced by varying the treatment parameters. At a longer treatment time in the overpressure steam, the same effect can be achieved with lower acid concentrations and vice versa. Likewise, the CSF value can be influenced with lower or higher temperatures of the steam treatment.

Apparently in doing so the fiber structure is specifically weakened, thereby increasing the fibrillation tendency.

In subsequent CSF testing, it should be noted that the millingtime required to achieve a CSF of 200 ml for untreated lyocell fibers is in the range of 12-16 minutes depending on the pulp type and production parameters (see FIG. 1). This procedure is comparable with that described in U.S. Pat. No. 8,187,422. The acid-treated lyocell fibers need only about 3-4 minutes to reach a CSF of 200 ml (FIG. 1) with the same milling method. In addition, it was found that the proportion of microfibers with <14 mesh and <2 μm diameter formed during grinding was significantly increased to more than 50% as a result of the acid pretreatment. As a result, it is possible to reduce the content of Lyocell fibers in a cleaning cloth to significantly <25 wt. %, according to the invention even below 20 wt. %, and nevertheless to obtain the required property profiles described, for example, in U.S. Pat. No. 8,187,422.

The fast fibrillating lyocell fibers according to the invention can be used according to the invention for the production of various products such as wipes, in particular disposable wipes, papers, in particular filter papers and papers for technical applications such as batteries, etc. These and other products as well as the production processes which are suitable for this purpose are described, inter alia, in WO 95/35399, which is hereby incorporated by reference, and the entire disclosure of which is incorporated by reference into the present patent application. In particular, wipes according to the invention can be produced from the fibers according to the invention and pulp according to known methods. In a preferred embodiment, the solidification is effected by hydroentanglement.

Subject of the present invention is also the use of the above-described fibers according to the invention for producing a wipe, said wipe containing pulp and 5 to 20 wt. % of fibrillated lyocell fibers. Preferably, the pulp is paper pulp.

In the following, the invention is described by means of examples. However, the invention expressly is not limited to these examples but includes all other embodiments based on the same inventive concept.

EXAMPLES

Example 1: Acid Treatment

Fast fibrillating lyocell fibers according to the invention are produced as follows: a lyocell fiber tow having a single fiber titer of 1.7 dtex is impregnated with dilute sulfuric acid at room temperature and at a liquor ratio of 1:10 and pressed to about 200% moisture. The impregnated fiber tow is pressurized with water vapor in a laboratory damper for approx. 10 min, then washed free of acid with water and dried. The dry fiber tow is cut to 5 mm staple length and subjected to CSF testing.

Example 2: Comparison of Fibrillation Dynamics

The fibrillation tendency is measured by means of CSF (Canadian Standard of Freeness) testing according to TAPPI Standard T227 om-94 and the fibrillation quotient Q is determined. The following were compared:

A. commercially available untreated 1.7 dtex/6 mm lyocell fibers, commercially available as Tencel® from Lenzing AG ("Tencel® Standard")

B. fibers acid-treated according to Example 1 ("Tencel® fast fibrillating")

FIG. 1 shows the decrease in CSF value with increasing comminution time in the measuring device. It can be seen clearly that the acid-treated fibers fibrillate much faster than the untreated fibers. For the practice of commercial manufacture of fibrillated lyocell fibers, this means a considerably lower time and energy expenditure than when using untreated lyocell fibers.

Table 1 shows the $t_{CSF200}$ values determined for the different samples and the Q values calculated therefrom.

TABLE 1

| Sample | $t_{CSF200}$ [min] | Q [$min^{-1}$] |
|---|---|---|
| A | 15.5 | 12.9 |
| B | 3.5 | 57.1 |

Example 3: Comparison of Suitability for Wet Laying Methods

The same fiber samples as in example 1 were compared:

1% Aqueous fiber suspensions of both fiber samples A and B were refined in a laboratory refiner of the Andritz R1L type at a power of 500 W, wherein both The energy consumption in kWh/to and the duration for reaching a freeness of CSF 200 (Canadian Standard of Freeness Testing according to TAPPI Standard T227 om-94) were determined. The fibrillating Lyocell fiber could be processed with less than 80% of the energy consumption compared to the standard Lyocell fiber in only 50% of the refining time (see Table 2).

TABLE 2

| Sample | Refining time [min] | Energy consumption [kWh/to] |
|---|---|---|
| A | 5 | 400 |
| B | 2.5 | 65 |

Figure 2:
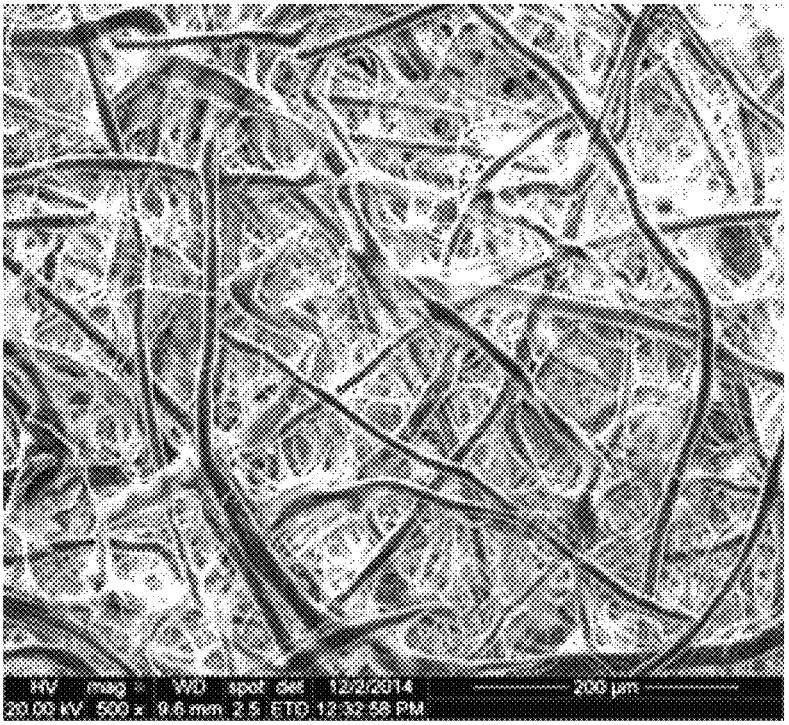
FIG. 2 is an SEM photograph of a sheet made from a suspension of exemplary fibers made in accordance with the present invention.

2000 ml were used to prepare test sheets in a sheet former of the Rapith Köthen type and SEM pictures of these test sheets were. FIG. 2 shows an SEM photograph of the sheet from the suspension of sample B.

What is claimed is:

1. A wipe comprising pulp and 5 to 20 wt. % of fibrillated lyocell fibers wherein the fibrillated lyocell fibers have a fibrillation quotient Q of 20 or more.

2. The wipe according to claim 1, wherein the pulp is paper pulp.

3. Fibrillated lyocell fibers having a fibrillation quotient Q of 20 or more, wherein said fibers comprise at least 50% microfibers, with-a fineness of less than 14 mesh and a diameter of less than 2 μm.

4. A wipe comprising the fibers of claim 3, wherein the wipe comprises pulp and 5 to 20 wt. % of fibrillated lyocell fibers.

5. The wipe according to claim 4, wherein the pulp is paper pulp.

6. A wet-laying process for producing a wipe, wherein said process comprises providing 5 to 20 wt. % of the fibrillated lyocell fibers according to claim 3 and pulp, and obtaining the wipe.

7. The process according to claim 6, wherein the pulp is a paper pulp.

* * * * *